US008590210B2

(12) United States Patent
Schindhelm et al.

(10) Patent No.: US 8,590,210 B2
(45) Date of Patent: Nov. 26, 2013

(54) ACTUATION METHOD FOR AN ELECTRIC WINDOW LIFTER, AND ACTUATION UNIT

(75) Inventors: Thomas Schindhelm, Neuhaus-Schierschnitz (DE); Christian Vetter, Hirschaid (DE)

(73) Assignee: Brose Fahrzeugteile GmbH & Co. Kommanditgesellschaft, Hallstadt, Hallstadt (DE)

( * ) Notice: Subject to any disclaimer, the term of this patent is extended or adjusted under 35 U.S.C. 154(b) by 57 days.

(21) Appl. No.: 13/171,605

(22) Filed: Jun. 29, 2011

(65) Prior Publication Data

US 2011/0314737 A1 Dec. 29, 2011

(30) Foreign Application Priority Data

Jun. 29, 2010 (DE) ..... 10 2010 025 503

(51) Int. Cl.
*E05B 15/08* (2006.01)

(52) U.S. Cl.
USPC ..... 49/506; 49/502; 296/146.2; 340/5.72

(58) Field of Classification Search
USPC ..... 49/502, 506; 296/146.2; 318/266, 466; 340/5.72
See application file for complete search history.

(56) References Cited

U.S. PATENT DOCUMENTS 4,571,884 A * 2/1986 Hetmann et al. ..... 49/72
5,810,423 A * 9/1998 Brackmann et al. ..... 296/146.2
6,166,508 A * 12/2000 Kalb ..... 318/632
6,246,195 B1 * 6/2001 Kloesters ..... 318/280
7,392,619 B2 * 7/2008 Pantke et al. ..... 49/506
2001/0033223 A1 * 10/2001 Zagler ..... 340/5.72
2006/0265965 A1 * 11/2006 Butera et al. ..... 49/502
2008/0125941 A1 * 5/2008 Mitteer ..... 701/46
2009/0100758 A1 * 4/2009 Nagakura ..... 49/334
2012/0005963 A1 * 1/2012 Zellmer et al. ..... 49/358
2012/0090240 A1 * 4/2012 Zellmer ..... 49/31
2012/0136532 A1 * 5/2012 Konchan ..... 701/36
2012/0234621 A1 * 9/2012 Syvret et al. ..... 180/281

FOREIGN PATENT DOCUMENTS

DE 19836761 C1 * 7/1999

* cited by examiner

*Primary Examiner* — Katherine Mitchell
*Assistant Examiner* — Abe Massad
(74) *Attorney, Agent, or Firm* — Laurence A. Greenberg; Werner H. Stemer; Ralph E. Locher

(57) ABSTRACT

An electric window lifter of a vehicle with a vehicle door having a frameless window is actuated according to a novel, low-wear actuation method. An entry signal is acquired that allows a conclusion to be drawn about whether a person has entered through this vehicle door. In this case, the window pane that is associated with the window of this given vehicle door is lowered by a short stroke by way of the window lifter in response to a central exit signal only when the entry signal was first identified. The window lifter or power window assembly includes an associated actuation unit with a query module that is configured for automatically carrying out the method.

8 Claims, 3 Drawing Sheets

ACTUATION METHOD FOR AN ELECTRIC WINDOW LIFTER, AND ACTUATION UNIT

CROSS-REFERENCE TO RELATED APPLICATION

This application claims the priority, under 35 U.S.C. §119, of German patent application DE 10 2010 025 503.3-23, filed Jun. 29, 2010; the prior application is herewith incorporated by reference in its entirety.

BACKGROUND OF THE INVENTION

Field of the Invention

The invention relates to an actuation method for an electric window lifter, or power window assembly, of a vehicle having a vehicle door which comprises a frameless window. In this case, the term "vehicle door" relates to a door of a vehicle which is used by people to enter and exit the vehicle, in particular to the side doors of a motor vehicle.

In high-quality vehicles, in particular in convertibles and coupes, vehicle doors of this kind are often provided with frameless windows in which the (window) pane that is associated with the window is held at its lower edge by a door leaf of the door, but in which the side and upper edges of the pane are not held by frame parts which are connected to the door to form a unit. Instead, when the pane is in the raised position and the vehicle door is closed, the upper edge of the pane is situated in a window seal which is fitted to the side edge of a vehicle roof or—in the case of a convertible—of a convertible top. In the process, the window seal usually also surrounds the outside of the upper edge of the pane, as a result of which the seal blocks the movement of the pane when the vehicle door is opened.

In order to nevertheless be able to open a frameless vehicle door without problems, the pane of a vehicle door of this kind generally has an associated electric window lifter which is equipped with a so-called short-stroke function. With the aid of the short-stroke function, before the door is opened, the pane is lowered to such an extent that it is no longer situated in the seal—this part of the function is called "short-stroke lowering operation" in the text which follows. The reverse process in which the pane is moved out of the slightly open position back into the completely closed position, and therefore into the seal, is called "short-stroke lifting operation". The term "short stroke" refers generally to the distance by which the pane has to be lowered or raised in order for its upper edge to move out of the seal and, respectively, to move into the seal.

The short-stroke lowering and lifting operations are usually triggered by a central signal in all the vehicle doors and the panes thereof at the same time. By way of example, the panes of all the vehicle doors are often lowered by the short stroke at the same time when the vehicle is unlocked from the outside and when the ignition key is withdrawn from an ignition lock of the vehicle. The panes of all the vehicle doors are once again raised by the short stroke at the same time when the vehicle is centrally locked from the outside and when the ignition is operated. The frequent implementation of the short-stroke function disadvantageously leads to comparatively high wear of the window lifter and the associated components. Secondly, the short-stroke function is often performed unnecessarily since, in most cases, not all the vehicle doors are opened after the vehicle is unlocked from the outside or the ignition key is withdrawn. For example, particularly frequently, only the driver's door is opened. In many further cases, only one or two further doors, in addition to the driver's door, are opened in a four-door vehicle.

SUMMARY OF THE INVENTION

It is accordingly an object of the invention to provide an actuation method for a power window assembly which overcome the above-mentioned disadvantages of the heretofore-known devices and methods of this general type and which provides for an actuation method for an electric window lifter of a vehicle having a vehicle door which comprises a frameless window, the method allowing the window lifter to be operated so as to minimize wear. The invention is also based on the object of specifying an apparatus which is suitable for automatically carrying out this method.

With the foregoing and other objects in view there is provided, in accordance with the invention, an actuation method for an electric window lifter of a vehicle that has a vehicle door with a frameless window. The method comprises the following method steps:

detecting an entry signal, the entry signal enabling a conclusion to be drawn whether or not a person has entered the vehicle through a respective vehicle door; and in response to a central exit signal, causing the window lifter to lower a window pane associated with the window of the respective vehicle door by a short stroke only when the entry signal was first identified.

In other words, the objects of the invention are achieved with a method, in which an entry signal is acquired which indicates whether or not a person has entered through the given vehicle door. The pane of a specific vehicle door is later lowered by a predefined short stroke in response to a central exit signal only if the entry signal was identified for that vehicle door. To be precise, the window lifter which is associated with this vehicle door is operated to perform a short-stroke lowering operation of the pane only when the central exit signal temporally follows an entry signal which is associated with this vehicle door.

In this case, a signal which indicates the termination of or an interruption in a journey, and therefore announces with a high degree of probability that one or more vehicle occupants will soon exit, is called an exit signal. The exit signal is "central" inasmuch as, contrary to the entry signal, it is independent of a specific vehicle door and therefore is generated for all the vehicle doors together.

Therefore, according to the invention, a short-stroke lowering operation of the pane—which is triggered centrally by the exit signal—is carried out on a specific vehicle door only when it can be assumed—in accordance with the previously detected entry signal—that a person has entered through this vehicle door, and accordingly may also possibly wish to exit again. However, the panes of vehicle doors for which an entry signal was not identified before the exit signal are not lowered.

As a result, the number of short-stroke cycles is advantageously considerably reduced, in particular for the window lifters of the passenger door and the rear doors which may be present, this equally also reducing the associated wear of the window lifter mechanisms. Avoiding short-stroke cycles additionally results in energy-saving operation of the window lifters and, on average, a reduction in the development of noise in the vehicle. Furthermore, the vehicle vibrations generated by the short stroke are reduced.

In this case, the combined use of the door-specific entry signal and the door-independent exit signal for triggering the short-stroke lowering operation permits convenient handling of the door-opening mechanism by the vehicle occupant, without multiple operations of the window lifters, which cause wear and expenditure of energy, being necessary in order to achieve this operator control convenience. The use of the central exit signal to trigger the short-stroke lowering operation specifically permits the short-stroke lowering operation to be carried out in good time before a specific vehicle occupant manifests his desire to exit the vehicle with his behavior, and therefore it is possible to identify which door the vehicle occupant actually wishes to exit from. The vehicle occupant can therefore immediately open the vehicle door when exiting the vehicle, without first having to wait for the short stroke. By remembering the previous entry signal, the method at the same time anticipates the vehicle doors which are to be opened in the process and prepares only these doors for exit, as a result of which unnecessary short-stroke cycles are saved.

In a preferred embodiment of the actuation method, provision is made for the entry signal to be derived from a door-warning signal which is associated with the vehicle door. A signal which indicates whether the vehicle door is open or closed is called a door-warning signal in this case. A door-warning signal of this kind is advantageously generated in any case in many vehicles—for example by a rotary catch sensor—in order to display, on a display on the dashboard, which vehicle doors are open or closed. A change in state of the door-warning signal which shows that the corresponding vehicle door is open is used as an entry signal in this case.

In addition, as a redundancy or as an alternative, the entry signal is derived from a seat-occupation signal of a vehicle seat which is associated with the vehicle door. In this case, a seat-occupation signal is generally understood to mean any signal which indicates whether the associated vehicle seat is occupied by a person, or possibly an object. These signals include, in particular, signals which are generated by conventional techniques by a weight sensor which is integrated in the seat, a headrest sensor for identifying the head position, an infrared or ultrasonic person-identification sensor or the like. The entry signal is preferably generated from the signal from a belt-buckle sensor which is provided in most modern vehicles in any case. In each of these cases, a change in the seat-occupation signal from the unoccupied state to the occupied state is used as an entry signal.

The withdrawal of an ignition key from an ignition lock of the vehicle is preferably used as the central exit signal. To be more precise, the exit signal is derived from an ignition lock-occupation signal of an ignition lock which indicates whether the ignition key is inserted in the ignition lock or withdrawn from the ignition lock. The change in state of the ignition lock-occupation signal from "ignition key inserted" to "ignition key withdrawn" is used as the exit signal in this case.

In an alternative variant of the method, switch-off of the ignition of the vehicle, that is to say the change in the actual ignition lock signal between the normal operating position (usually designated "ON") of the vehicle and the usually present activation mode (usually designated "ACC") for the peripheral loads in the vehicle, for example the car radio, is used as the central exit signal. Once again, it is also possible, as an alternative, for the change in the ignition lock signal between the activation mode and the steering wheel lock activation stage (usually designated "LOCK") to be used as the central exit signal.

In principle, the window lifters of all the vehicle doors can be actuated in the same way by means of the method described above. However, in a preferred embodiment, only the passenger door and—in the case of a four-door vehicle—the rear side doors are actuated. In this embodiment, the pane which is associated with the driver's door is, however, always lowered by the short stroke without taking into consideration entry signals each time the central exit signal is identified, since an exit request can be expected at the driver's door after every journey.

In an expedient development of the method, provision is made for a short-stroke lifting operation to be initiated in response to a central locking signal, which follows the central exit signal, only when the entry signal was first identified. Therefore, only the window lifters of those panes which were lowered in response to the previous exit signal in accordance with the door-specific entry signal are operated when the vehicle is locked. However, the window lifters of the other panes, which were not lowered at all on account of the lack of an entry signal, are not actuated and accordingly not subject to wear.

With the above and other objects in view there is also provided, in accordance with the invention, an apparatus or device that is enabled to carry out the above-outlined method. In this case, a query module is provided as part of an actuation unit for actuating an electrical window lifter, the query module being designed for automatically carrying out the actuation method according to the invention in any one of the above-described variants.

In an advantageous refinement, the actuation unit is a microprocessor in which the query module is implemented as a functional constituent part of a control software system. In this case, the actuation unit is designed to carry out the method in a software-based fashion in the sense that the actuation unit carries out the method according to the invention when it is operated as intended. However, as an alternative, the actuation unit can also be designed to carry out the method according to the invention in a circuit-based fashion, that is to say can contain a non-programmable electronic circuit which carries out the method according to the invention when it is operated as intended. In this variant, the actuation unit can be realized, in particular, in the form of a so-called ASIC.

Other features which are considered as characteristic for the invention are set forth in the appended claims.

Although the invention is illustrated and described herein as embodied in an actuation method for an electric window lifter, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
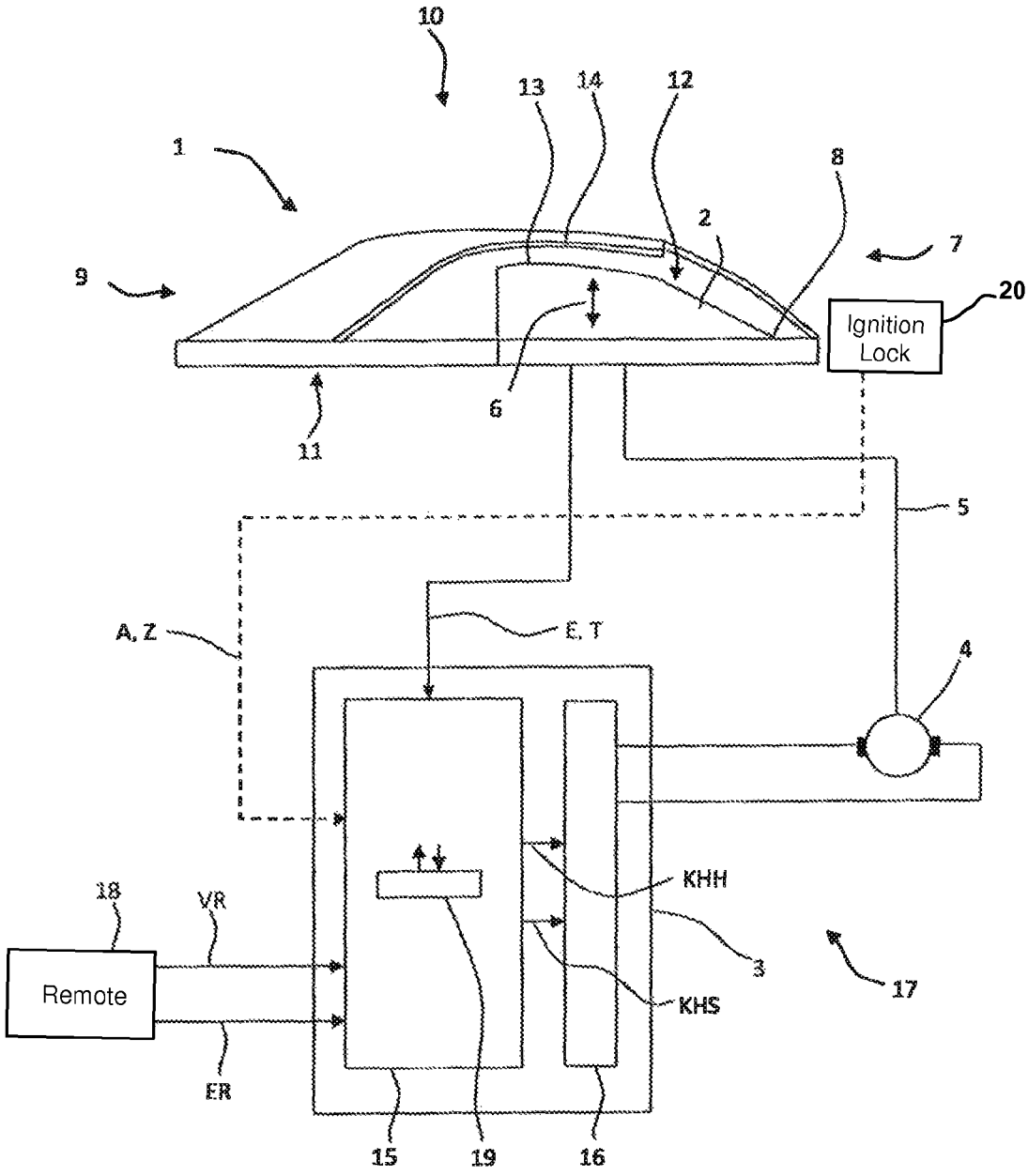
FIG. 1 shows a schematic illustration of an actuation unit having a query module for actuating an electric window lifter for a door of a convertible.

Referring now to the figures of the drawing in detail and first, particularly, to FIG. 1 thereof, there is shown a highly diagrammatic detail of a vehicle, in this case a convertible 1, having a partially opened window pane 2 of a side window. The convertible 1 comprises an actuation unit 3 for automatically opening and closing the pane 2. The actuation unit 3 controls an electric (window winder) motor 4, which is associated with the pane 2, and, for its part, moves the pane 2 with a linear movement which is identified by an arrow 6 by means of a diagrammatically illustrated actuating mechanism 5.

The pane 2 is part of a (vehicle) door 8, in this case the passenger door. A rear pane, which faces a rear side 9 of the convertible 1, which rear side is opposite the front side 7, is illustrated in the open state and therefore cannot be seen in the illustration.

For orientation purposes, the upper side 10 of the convertible 1, the upper side being associated with the convertible top 2, and the lower side 11 of the convertible, the lower side being opposite the upper side, are also indicated in FIG. 1.

The pane 2 of the door 8 has an associated frameless window 12. When the window 12 is closed, the pane 2 is situated with its upper edge 13 in a seal 14 which is fitted laterally at the edges of the convertible top, more precisely in a groove in the convertible top. In the event of a short-stroke lowering operation, the pane 2 is moved downward just to such an extent that the edge 13 is no longer situated in the seal 14. In the event of a short-stroke lifting operation, the edge 13 of the pane 2 is once more moved back into the seal 14.

The control unit 3 is realized in the form of a microcontroller containing implemented control software, with the control software comprising, in particular, a query module 15 and a short-stroke module 16 as functional constituent parts. In this case, the control unit 3, preferably together with the motor 4, forms an electric window lifter 17, or power window assembly 17, which is integrated in the door 8. A corresponding window lifter 17 is also associated with each of the further vehicle doors 8 of the vehicle.

The short-stoke module 16 is designed, in a program-based fashion, to actuate the motor 4 to perform a short-stroke movement. In this case, the short-stroke module 16 triggers a short-stroke lowering operation when a lowering signal KHS is received, and triggers a short-stroke lifting operation when a lifting signal KHH is received.

The lowering signal KHS and the lifting signal KHH are supplied to the short-stroke module 16 by the query module 15 which is connected upstream and, for its part, is supplied with a central locking signal VR, a central unlocking signal ER, an entry signal E and a central exit signal A as input variables.

The locking signal VR and the unlocking signal ER are each generated by corresponding operation of a radio remote control means 18 which can be integrated in the usual manner, for example, in an ignition key. The signals VR and ER which are emitted by the radio remote control means 18 outside the convertible 1 are received by a non-illustrated vehicle-internal radio receiver and transmitted to the actuation unit 3.

The entry signal E is derived by the actuation unit 3 from a door-warning signal T which is detected by a non-illustrated rotary catch sensor of the door 8 and which indicates whether or not the door 8 is closed. Specifically, the query module detects, as the entry signal E, a change in state of the door-warning signal which indicates that the door 8 is open. The door-warning signal T has, for example, a digital state "1" when the door 8 is not completely closed, and otherwise has a digital state "0". In this case, the entry signal E is given by the change in state of the door-warning signal T from "0" to "1". The states "1" and "0" are prespecified by electrical voltage values which can be selected as desired but can be distinguished from one another, for example +5 V and 0 V.

The exit signal A is derived by the actuation unit 3 from an ignition lock-occupation signal Z which is generated by an ignition key sensor (not illustrated) of an ignition lock 20 and which indicates whether the ignition key is inserted in the ignition lock 20. Specifically, the actuation unit 3 detects, as the exit signal A, a change in state of the ignition lock-occupation signal Z which indicates that the ignition key is withdrawn from the ignition lock 20. The ignition lock-occupation signal Z has, for example, a digital state "1" when the ignition key is inserted in the ignition lock 20, and otherwise has a digital state "0". In this case, the exit signal A is given by the change in state of the ignition lock-occupation signal Z from "1" to "0". The states "1" and "0" are once again prespecified by electrical voltage values which can be selected as desired but can be distinguished from one another, for example +5 V and 0 V.

The attribute "central" in relation to the unlocking signal ER, the locking signal VR and the exit signal A, shows that these signals ER, VR and A are generated independently of a specific vehicle door, and are accordingly supplied to each window lifter which is associated with a vehicle door, and are utilized by each of these window lifters. In contrast to these central signals ER, VR and A, the entry signal E is door-specific. Therefore, a separate entry signal E is detected for each vehicle door and—preferably selectively and exclusively—supplied to the window lifter 17 which is associated with this vehicle door. The respective query module 15 utilizes the entry signal E in such a way that it sets a marker 19 when an entry signal E is received. In the illustrated example, the marker 19 is a so-called "flag" or status bit, that is to say a memory unit of a data memory (not explicitly illustrated) which is associated with the actuation unit 3 and is actuated by the query module 15. The marker 19 has, for example, a marker value M=1 in the set state, and a marker value M=0 in the unset state.

Figure 2:
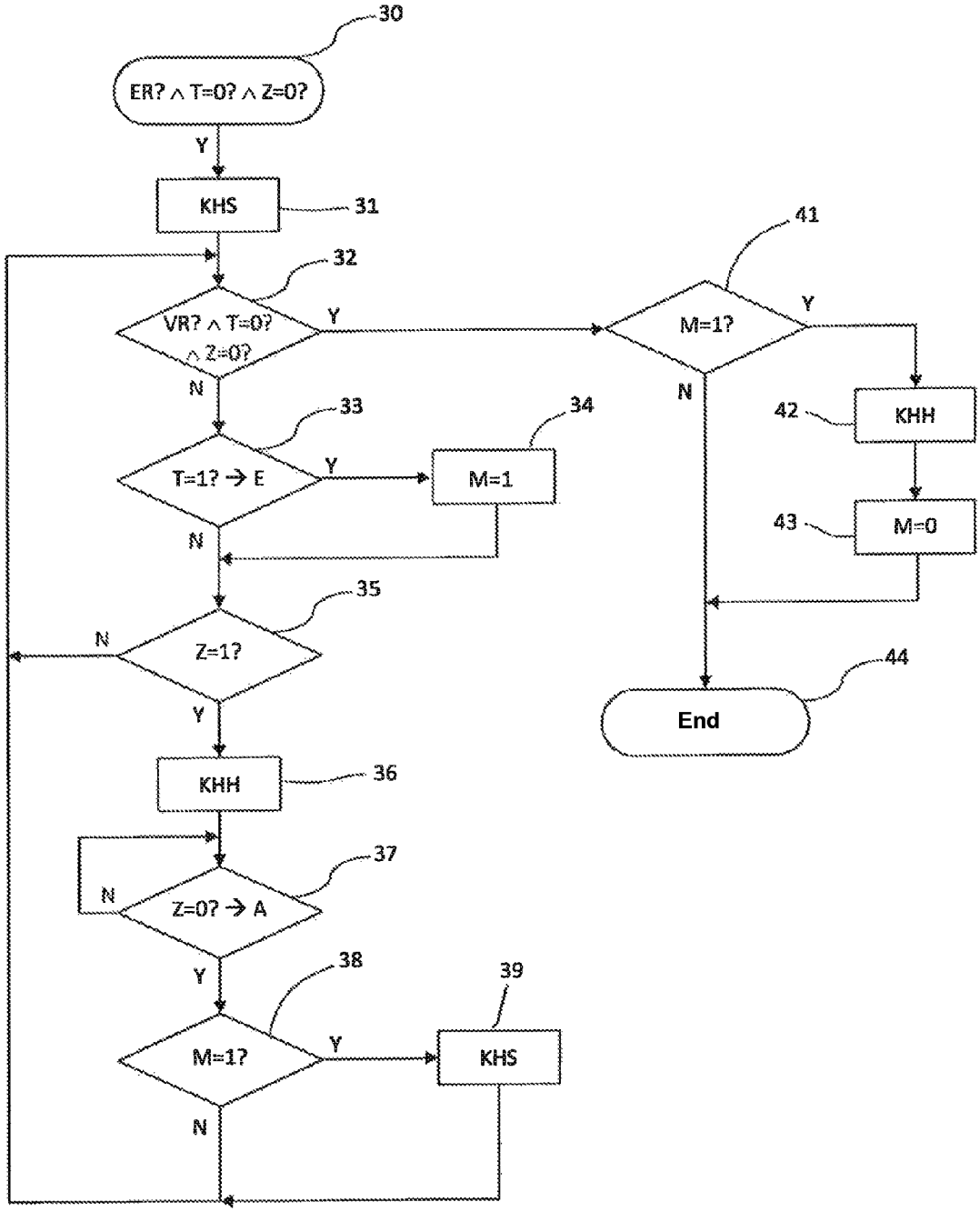
FIG. 2 shows a flowchart for the actuation method, which is carried out by the query module, for actuating the short-stroke module.

In order to actuate the short-stroke module 16 using the signals ER, VR, E and A, the query module 15 automatically executes an actuation method which is illustrated in greater detail in FIG. 2.

In a first step 30, the actuation method is started by the query module 15 as soon as it receives the unlocking signal ER, that is to say as soon as a vehicle user unlocks the convertible 1 from the outside by way of the radio remote control means 18. As a secondary condition for starting the actuation method, the query module 15 checks, in step 30, whether the door-warning signal T and the ignition lock-occupation signal Z have the value "0", that is to say whether the door 8 is closed and the ignition key is withdrawn. These secondary conditions are always met when the convertible 1 is properly unlocked from the outside by way of the radio remote control means 18 that is integrated in the ignition key.

In a following step 31, the query module 15 in this case transmits the lowering signal KHS to the short-stroke module 16 which, in response, initiates the short-stroke lowering operation of the window pane 2 by actuating the motor 4. This is done independently of whether a person has actually entered through the door 8 or not. In particular, the central unlocking signal ER—as mentioned above—is transmitted to all the window lifters 17 which are associated with a vehicle door 8 and are utilized by said window lifters in the manner described above. Therefore, when the convertible 1 is unlocked, the panes 2 of all the vehicle doors 8 are lowered by the short stroke, as a result of which the panes 2 are moved out of the respective seal 14 of the convertible top.

Following step 31, the query module 15 checks, in a query 32 (explained in greater detail below) as a termination condition, whether the locking signal VR is present, that is to say whether the convertible 1 has been locked again from the outside by means of the radio remote control means 18. As a secondary condition for the termination of the actuation method, the query module 15 additionally checks, in step 32, whether the door-warning signal T and the ignition lock-occupation signal Z have the value "0", that is to say whether the door 8 is closed and the ignition key is withdrawn from the ignition lock 20. These secondary conditions are once again always met when the convertible 1 is properly locked from the outside by means of the radio remote control means 18 which is integrated in the ignition key.

If the convertible 1 has not been locked again (branch "N" in query 33), the query module 15 checks, in a subsequent query 33, whether the respectively associated door 8, that is to say the passenger door in this case, is still open and the door-warning signal T accordingly has the value "1". If this is the case (branch Y in query 33), the query module 15 identifies this as an entry signal E, that is to say as an indication that a person has entered through the associated door 8, and accordingly sets the marker 19 to an activated state, for example to the marker value M=1, in a step 34.

Steps 33, and possibly 34, are carried out by each window lifter 17 which is associated with a vehicle door 8, so that information relating to which doors 8 of the convertible 1 have been entered by people is stored in the respective markers 19 of the window lifters 17.

Following step 34, or when the door-warning signal T is again at the value "0" and therefore no entry signal E has been identified (branch "N" in query 33), the query module 15 checks, in a query 35, whether the ignition key is inserted in the ignition lock 20 by evaluating the ignition lock-occupation signal Z. If yes (branch Y in query 35), a lifting signal KHH is output to the short-stroke module 16 in step 36, and the pane 2 is again raised into the seal 14. This step 36 is also carried out by all the windows winders 17 which are associated with a vehicle door 8, and therefore all the associated panes 2 are raised by the short stroke when the ignition key is inserted into the ignition lock 20.

If the ignition key is not inserted in the ignition lock 20, and accordingly the ignition lock-occupation signal Z also has the value Z=0 (branch N in query 35), the query module 15 returns to step 32.

Following step 36, the query module 15 checks whether the central exit signal A is received. To this end, a check is made in query 37 as to whether the ignition lock-occupation signal Z has the value Z=0, that is to say whether the ignition key has already been withdrawn from the ignition lock 20. In this case, step 37 is repeated by the query module 15 (branch N in query 37) until the ignition key is withdrawn and the ignition lock-occupation signal Z consequently jumps to the value Z=0. The query module 15 identifies this event as an exit signal A and in this case (branch Y in query 37) starts a subsequent query 38.

In query 38, the query module 15 checks whether the marker 19 is set, that is to say the marker value is M=1. If yes (branch Y in query 38), the query module 15 outputs a lowering signal KHS to the short-stroke module 16 in a step 39, said short-stroke module again lowering the associated pane 2 by the short stoke in response to said lowering signal. Since each window lifter 17 has set, or has not set, the associated marker 19 individually in accordance with the door-specific entry signal E, only the panes 2 of those doors 8 which had been previously opened are lowered. Therefore, in general, only the panes 2 of those doors through which a person had previously entered are lowered.

Following step 39 or—in the event of a negative check result (branch N in query 38)—following query 38, the query module 15 returns to query 32 and therefore again checks the above-described termination condition. A check is therefore made as to whether the convertible 1 is locked from the outside by means of the radio remote control means 18—with the ignition key withdrawn and the door 8 closed.

If this is the case (branch Y in query 32), a check is again first made by the query module 15 in query 41 as to whether the marker 19 is set. If yes (branch Y in query 41), the query module 15 outputs the lifting signal KHH to the short-stroke module 16 in a step 42, and thus prompts said short-stroke module to lift the pane 2 of the door 8 in question by the short stroke. Following step 42, the query module 15 resets the marker 19 to the marker value M=0 in a step 43. The query module 15 then terminates the actuation method in a step 44.

If the marker 19 proves to not be set (marker value M=0) in query 41, the query module 15 terminates the actuation method immediately (branch N in query 41).

In the above-described embodiment, identical window lifters 17 are—as mentioned—associated with all the vehicle doors 8. The above-described actuation method is therefore carried for the panes 2 of all vehicle doors 8 in the same way. In a departure from this, the window lifters 17 which operate in accordance with the above-described actuation method are used only for the passenger door and—if present—the rear side doors in an alternative embodiment. However, a simplified window lifter is associated with the driver's door, said window lifter always lowering the associated pane when the vehicle is unlocked from the outside and when the ignition key is withdrawn. The simplified actuation method for the driver's door therefore corresponds substantially to the method depicted in FIG. 2, but without the queries 33, 38 and 41 and the steps 34, 39 and 43. This takes into account the situation that the driver's door is generally always opened after the vehicle is unlocked and after the ignition key is withdrawn, while the other vehicle doors are operated substantially more rarely.

In principle, the control logic system can be divided as desired among the window lifters or even implemented separately from the window lifters. Instead of a plurality of actuation units 3 which are each separately associated with each window lifter 17, a central actuation unit for all four doors is provided in a further embodiment. This central actuation unit can once again actuate all two or four vehicle doors 8 in the same way in accordance with the above-described method. As an alternative, the central control unit once again controls only the window lifters of the passenger door and possibly the rear side doors in accordance with the above-described method, while it controls the window lifter of the driver's door in accordance with the simplified method. In a further alternative embodiment, the query module 15 of the window lifter which is associated with the front doors 8 additionally contains the control logic system for the window lifter of the door which is situated behind it. The window lifter of the left-hand-side front door therefore also controls the window lifter of the left-hand-side rear door, while the window lifter of the right-hand-side front door also controls the window lifter of the right-hand-side rear door.

The actuation unit additionally expediently comprises an emergency-opening module (not explicitly illustrated and preferably likewise realized in a software-based fashion) which actuates the short-stroke module in order to lower the respective piece of glass even when, according the above-described method, a short-stroke lowering operation has not been performed and a door opener of the vehicle door is nevertheless operated. This emergency-opening function is necessary in rare cases when, after the exit signal is generated, a vehicle door through which a person had not previously entered is opened, for example when a person enters on one side of the vehicle and exits from the opposite side. In this case, the emergency-opening module blocks the door opener until the short stroke is concluded. In these rare cases, the vehicle occupant therefore has to operate the door opener twice or keep it operated until the short stroke is concluded in order to open the door.

Figure 3:
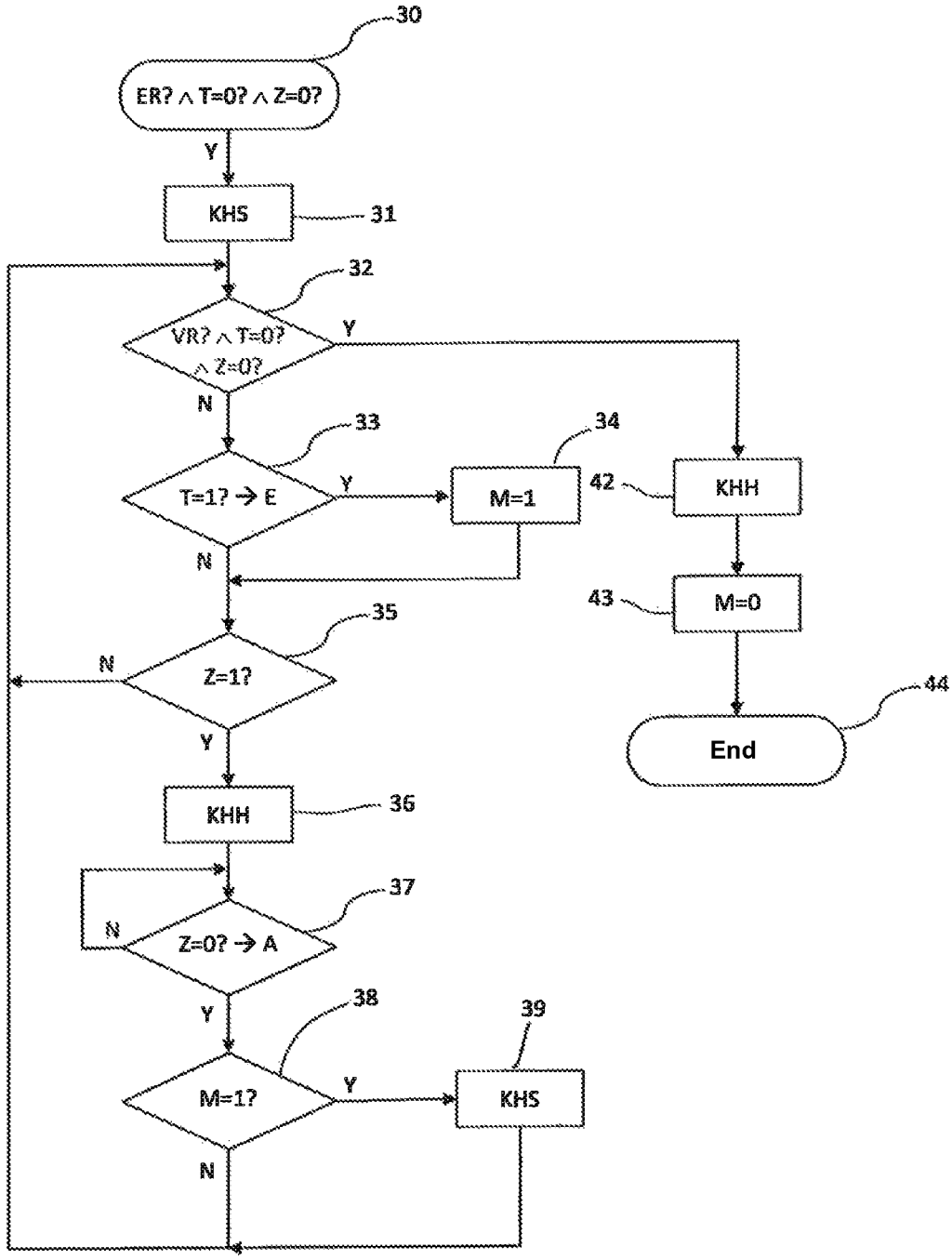
FIG. 3 shows an illustration according to FIG. 2 of a variant of the method in FIG. 2.

FIG. 3 shows a simplified variant of the above-described method. This method variant differs from the above-described embodiment of the method only in that the query 41 is omitted, and therefore the lifting signal KHH is always output in step 42 when the termination condition which is checked in the query 32 is fulfilled.

The invention claimed is:

1. An actuation method for an electric window lifter of a vehicle that has a vehicle door with a frameless window, the method which comprises:

detecting an entry signal derived from a door-warning signal associated with the vehicle door and generated by a rotary catch sensor, the entry signal enabling a control unit to draw a conclusion about whether or not a person has entered the vehicle through a respective vehicle door; and in response to a central exit signal, causing the window lifter to lower a window pane associated with the window of the respective vehicle door by a short stroke, wherein the central exit signal is indicative of a termination or interruption of a journey of the vehicle and of a high probability that one or more occupants are about to exit from the vehicle, and the central exit signal is independent of a specific vehicle door, and wherein the window pane is only lowered in response to the central exit signal when the entry signal was identified prior to detecting the central exit signal.

2. The actuation method according to claim 1, which comprises deriving the entry signal from a seat-occupation signal of a vehicle seat associated with the vehicle door.

3. The actuation method according to claim 1, which comprises deriving the entry signal from a seat-occupation signal of a vehicle seat associated with the vehicle door.

4. The actuation method according to claim 1, which comprises using a signal indicating a withdrawal of an ignition key from an ignition lock of the vehicle as the exit signal.

5. The actuation method according to claim 1, which comprises using a signal indicating a switch-off of an ignition of the vehicle as the exit signal.

6. The actuation method according to claim 1, which comprises causing the window lifter to raise the pane of the respective vehicle door associated with the entry signal by the short stroke only when the entry signal and the subsequent exit signal have been identified and in response to a subsequent, central locking signal.

7. An actuation unit for an electric window lifter of a vehicle having a vehicle door with a frameless window, the actuating unit comprising: a query module configured to automatically carry out the method according to claim 1.

8. An actuation method for an electric window lifter of a vehicle door with a frameless window, the method comprising:

detecting a central exit signal, the central exit signal being indicative of a termination or interruption of a journey of the vehicle and indicative of a high probability that one or more occupants are about to exit from the vehicle, and the central exit signal being independent of a specific vehicle door;

in response to receiving the central exit signal, checking whether or not an entry signal was first identified, the entry signal having been derived from a door-warning signal generated by a rotary catch sensor and associated with the vehicle door, the door-warning signal enabling a control unit to draw a conclusion about whether or not a person has entered the vehicle through the respective vehicle door;

if the entry signal was first identified, causing the window lifter to lower a window pane associated with the window of the respective vehicle door by a short stroke; and if the entry signal was not first identified, not causing the window lifter to lower the window pane associated with the window of the respective vehicle door by a short stroke.

* * * * *